United States Patent [19]

Kaim

[11] 4,333,576

[45] Jun. 8, 1982

[54] CARRIER ASSEMBLY FOR USE WITH A ROTARY RAILROAD COUPLER SYSTEM

[75] Inventor: John W. Kaim, Chicago, Ill.

[73] Assignee: Amsted Industries Incorporated, Chicago, Ill.

[21] Appl. No.: 124,332

[22] Filed: Feb. 25, 1980

Related U.S. Application Data

[63] Continuation-in-part of Ser. No. 957,709, Nov. 6, 1978, abandoned.

[51] Int. Cl.[3] ..... B61G 9/22

[52] U.S. Cl. ..... 213/61; 213/62 A

[58] Field of Search ..... 213/21, 60, 61, 62 R, 213/62 A

[56] References Cited

U.S. PATENT DOCUMENTS

| | | | |
|---|---|---|---|
| 1,065,646 | 6/1913 | Westlake | 213/61 |
| 3,104,017 | 9/1963 | Kulieke et al. | 213/61 |
| 3,610,436 | 10/1971 | Wisler | 213/61 |

*Primary Examiner*—Randolph A. Reese

*Attorney, Agent, or Firm*—Edward J. Brosius; Fred P. Kostka; Tony T. Shu

[57] ABSTRACT

To maintain horizontal alignment of a shank and attached coupler head of a rotary railroad coupler system, a middle portion of the shank is supported by a carrier assembly connected to a striker casting of the coupler system. During rotation of the shank and coupler head in a dumping procedure, for example, the shank interfaces with a saddle casting portion of the carrier assembly to cause wear thereof. To facilitate replacement of the saddle casting portion once wear becomes excessive, the saddle casting portion is provided with spaced inverted T-shaped lugs which allow the saddle casting portion to be removed from a carrier portion of the carrier assembly by means of spaced grooves provided in the carrier portion. Separation of the saddle casting portion from the carrier portion, however, is prevented when the saddle portion and carrier portion are misaligned.

3 Claims, 13 Drawing Figures

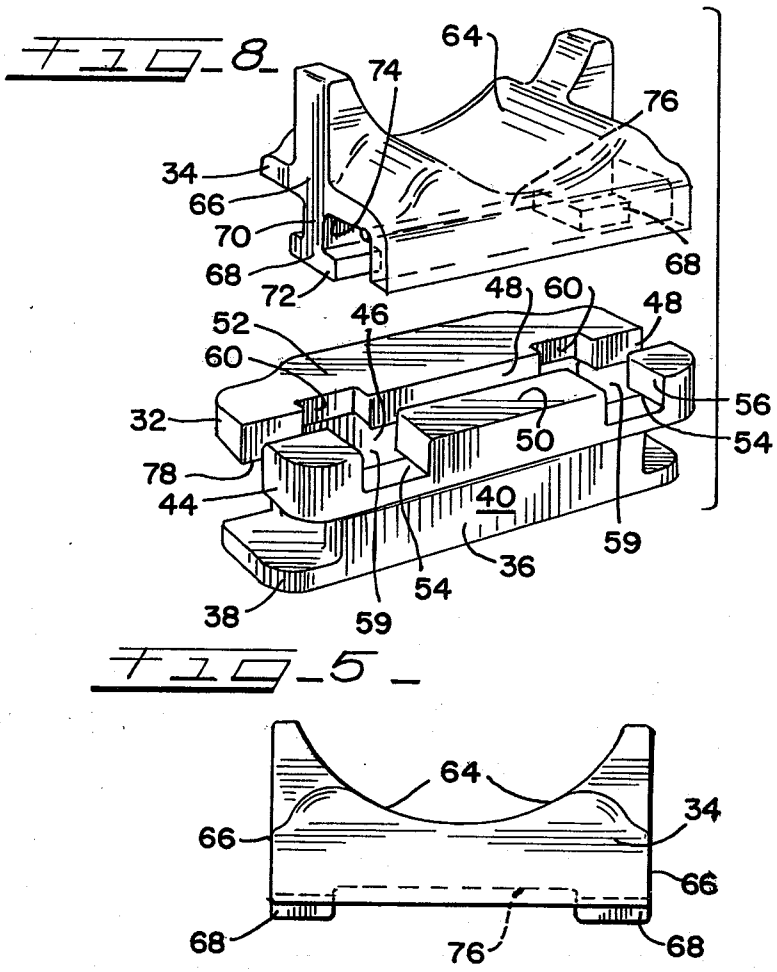
FIG. 8
FIG. 5
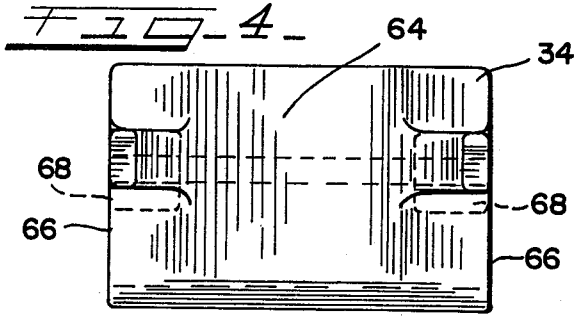
FIG. 4
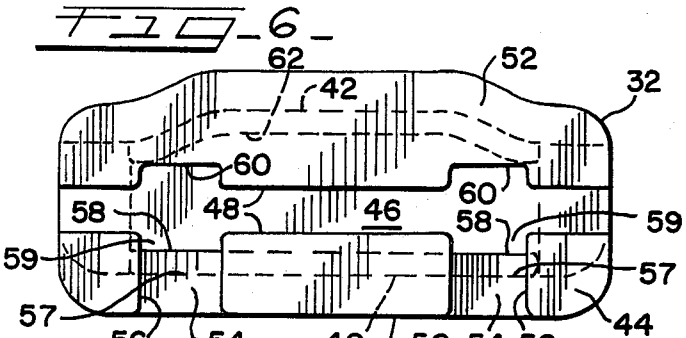
FIG. 6
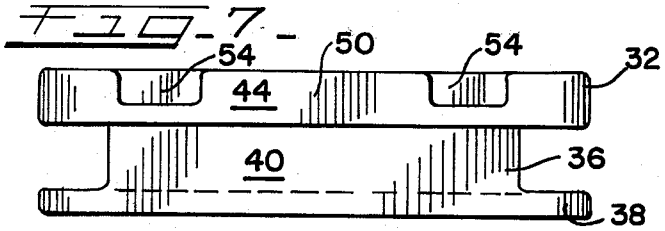
FIG. 7

CARRIER ASSEMBLY FOR USE WITH A ROTARY RAILROAD COUPLER SYSTEM

This patent application is a continuation-in-part of patent application U.S. Ser. No. 957,709 filed Nov. 6, 1978, and now abandoned.

BACKGROUND OF THE INVENTION

1. Field of the Invention

This invention relates to rotary coupler systems for use with railroad freight cars and more particularly to a carrier assembly which inhibits droop of a cylindrical rotary coupler shank and its attached type-E coupler head.

2. Description of the Prior Art

Type-F rotary coupler systems are in common use today with railroad freight cars. Rotary coupler systems allow individual rotation of joined cars so that contents in the individual cars may be readily removed by dumping such. The F-type rotary coupler system may be modified to incorporate an E-type coupler head and a cylindrical shank portion. When so modified, a carrier assembly is used to help support the shank portion.

U.S. Pat. No. 2,743,822 sets forth the type-F coupler in considerable detail. U.S. Pat. No. 3,610,436 discloses means by which a striker assembly of a type-F coupler may be modified to use the type-E coupler head and cylindrical shank portion. As shown, a carrier assembly comprising a carrier portion, being in this case an adapter, and a saddle casting portion is placed in a spring box formed as part of the type-F striker casting. The saddle casting portion helps support the coupler shank while allowing the shank and coupler head to rotate during a dump procedure. The saddle casting also allows the shank and coupler head to swing laterally as the railroad car to which the coupler is attached travels about a curved section of track, for example. Another example of carrier assembly for a rotary coupler system is shown in U.S. Pat. No. 3,104,017.

Heretofore, the type-E coupler system has not been adapted as a rotary coupler for use by the U.S. railroad industry.

SUMMARY OF THE INVENTION

A rotary coupler system adapted for use with a railroad freight car which may be selectively inverted to dump contents of the car includes a coupler head affixed to an outer end of an elongated cylindrical shank. The shank in turn is rotatively carried in a yoke of the coupler system and operatively connected to such by a pin and a yoke collar.

Where the rotary coupler is modified to use a type-E coupler head and cylindrical shank, the shank is maintained in horizontal alignment by a carrier assembly supported by a striker casting of the type-F rotary coupler system. In this arrangement, the carrier assembly comprises a carrier portion, being in this case an adapter, and a saddle casting portion. The adapter is disposed in a spring box formed as part of the type-F striker casting and includes a top horizontal flange extending over a box-like base below. An elongated slot divides the top flange into a front section and a rear section. The front section of the flange is further divided by two spaced grooves positioned laterally to the slot. Extending rearwardly and terminating within the rear flange section are a pair of notches which are positioned to align with the grooves.

The saddle casting portion of the carrier assembly includes a cradle containing a concave indentation formed on a radius to complementarily receive the coupler shank. Extending downwardly from the cradle are spaced lugs having an inverted T-shaped cross-sectional configuration. The lugs of the saddle portion may be conveniently placed in the grooves of the adapter flange and slid rearwardly. When the lugs align with the slot, the lugs may drop within the base of the adapter so that a bottom of the cradle of the saddle casting portion is in contact with the flange of the adapter.

A somewhat similar arrangement is also usable with a type-E rotary coupler system now under development. In this type of system, the carrier assembly comprises the identical saddle casting portion but the adapter portion and spring box are eliminated. The carrier portion in turn is formed as an integral part of a type-E striker casting. This striker casting is formed with a front peripheral flange about an opening in which a shank of the coupler system is disposed. A bottom horizontal portion of this front flange includes a horizontal ledge divided into a front and a rear section by a lateral slot. The slot provides access to an inner space below. The front section of the horizontal ledge contains a pair of grooves spaced to receive the lugs of the saddle casting portion. The rear section of the ledge contains a like pair of spaced recesses. The grooves and recesses allow the saddle casting lugs to be slid rearward so as to drop into the inner space within the bottom horizontal flange portion of the striker casting.

As so disposed, the saddle casting portion may move laterally within the flange slot of the adapter used with the type-F striker casting or the ledge slot in the type-E striker casting. Such lateral movements of the saddle casting portion are required because of its engagement with the coupler shank which swings during operation of the railroad car. When lateral movement of the shank does occur, the saddle casting portion becomes locked within the adapter or the bottom flange portion by an interference between the saddle lugs and the front and rear sections of the adapter or the front and rear sections of the horizontal ledge respectively.

The saddle assembly of this invention has several advantages over those presently known.

During rotation of the coupler shank and head in a dumping procedure, there is moving contact between the shank and the cradle of the saddle casting portion which produces wear. When the wear becomes excessive such that the shank and coupler head droop excessively, the saddle casting portion must be replaced. Heretofore, replacement of the saddle casting portion required the shank be withdrawn from the yoke of the coupler system before the saddle casting portion could be replaced.

As provided by this inventive carrier assembly, the saddle casting portion may now be removed and replaced without such disassembly. Thus, maintenance costs are minimized and the time that the railroad car must be withdrawn from service is reduced substantially.

Also, during rotation of the shank and coupler head in a dump procedure, under the influence of gravity, the shank and coupler head drop from a horizontally aligning position. This movement causes the saddle casting portion to slide to a position where its lugs no longer align with the grooves and notches in the adapter portion or the grooves and recesses in the flange ledge, as the case may be. Thus, the saddle casting portion cannot become inadvertently separated from the striker casting under the influence of gravity or other force because of the interference fit created.

Another important advantage of this invention is that the same saddle casting portion is to be used in the type-E rotary coupler system as is being used in the modified type-F rotary coupler system. Manufacturing and inventory costs are thus held to a minimum.

DESCRIPTION OF THE DRAWINGS

FIG. 4 is a plan view of the saddle casting portion of the carrier assembly of FIG. 3.

FIG. 5 is a front elevational view of the saddle casting portion of FIG. 4.

FIG. 6 is a plan view of the adapter of the carrier assembly of FIG. 3.

FIG. 7 is a front elevational view of the adapter of FIG. 6.

FIG. 8 is a perspective view of the saddle casting portion and of the adapter shown in the prior figures.

DESCRIPTION OF THE PREFERRED EMBODIMENT

Figure 1:
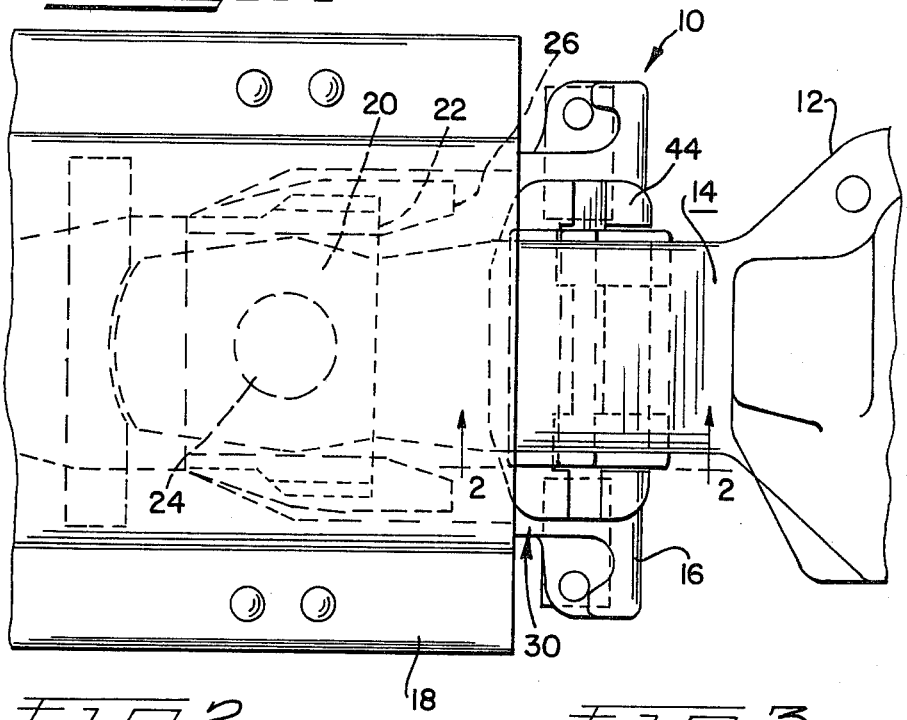
FIG. 1 is a plan view of a portion of a type-F rotary railroad coupler system incorporating the carrier assembly of this invention so as to use a type-E shank and coupler head.

A type-F rotary railroad coupler system as seen in FIG. 1 is shown generally and designated 10. The coupler system 10 has been modified to use a type-E coupler head 12 positioned at an outer end of a cylindrical shank 14. The shank 14 in turn is positioned within a striker 16 which is carried by a sill 18. The sill 18 in turn is connected to a body of a railroad car (not shown) in a known manner.

An inner end 20 of the shank 14 is connected to a yoke collar 22 by a pin 24. The yoke collar 22 in turn is rotatively carried in a yoke 26 positioned within the striker 16 and the sill 18. During a dumping procedure in which a railroad car connected to the coupler system 10 is rotated to an inverted position so as to effect a gravity release of contents therein, the coupler head 12, shank 14, pin 24 and yoke collar 22 also rotate.

The type-F striker 16 is provided with a spring box 28 positioned below and laterally across a lower front portion of the striker 16. To allow the type-E coupler head 12 and shank 14 to be used in the type-F coupler system 10, a carrier assembly 30 is mounted in the spring box 28.

As may best be understood by viewing FIGS. 2–8, the carrier assembly 30 comprises a lower carrier portion, which in this case is an adapter 32, and an upper saddle casting portion 34. The adapter 32 and the saddle portion 34, when referred to, often include the term "casting" which describes a common method of fabrication employed.

The adapter 32 has a lower base portion 36 defined by a bottom 38 and a front and a rear sidewall 40, 42 each having end walls which terminate short of the ends of the bottom 38. The base 36 of the adapter 32 is so dimensioned to fit snugly within the spring box 28. Vertical displacement of the adapter 32 within the spring box 28 is limited by a top flange 44 which extends outwardly from and about a top of the base 36. Access to an inner space 46 of the base 36 is provided by a slot 48 which extends between sides of the flange 44. The slot 48 divides the top flange 44 longitudinally into a front flange section 50 and a rear flange section 52.

Further dividing the front flange section 50 are spaced grooves 54 positioned perpendicular to the slot 48. An outer side 56 of each groove 54 is proximately aligned with the sidewalls of the front and rear walls 40, 42 of the adapter base 36. A front part 57 of the grooves 54 has a depth proximating one-half of a thickness of the flange 44. A rear part 59 of the groove 54 is full depth. The front and rear parts 57, 59 join at a point which is proximately aligned with an inner surface 58 of the base front wall 40.

In the rear flange section 52 are spaced notches 60 which align with the grooves 54 respectively. These notches 60 are full depth and terminate within the rear flange section 52 adjacent to an inner surface 62 of the rear wall 42.

The saddle casting portion 34 comprises an upper cradle area 64 containing a concave recess formed on a radius to complementarily accommodate the cylindrical-shaped shank 14. Positioned to align with outer sidewalls 66 of the cradle area are spaced, inverted T-shaped lugs 68. Each lug 68 is defined by an upper vertical part 70 joined by a lower horizontal part 72. The spacing of the lugs 68 and width of each lug 68 is such that the lugs 68 may conveniently fit in the grooves 54 and the notches 60 of the adapter flange 44. Joined to a bottom 74 of the cradle area 64 and positioned between the lugs 68 is an elongated rib 76. A height of the rib 76 proximates but is slightly less than the dimension of the vertical part 70 of each lug 68.

Figure 2:
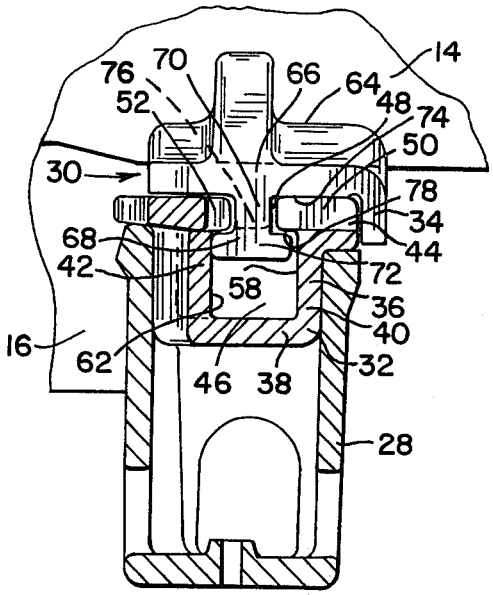
FIG. 2 is a fragmentary cross-sectional elevational view as seen generally along the line 2—2 of FIG. 1.
Figure 3:
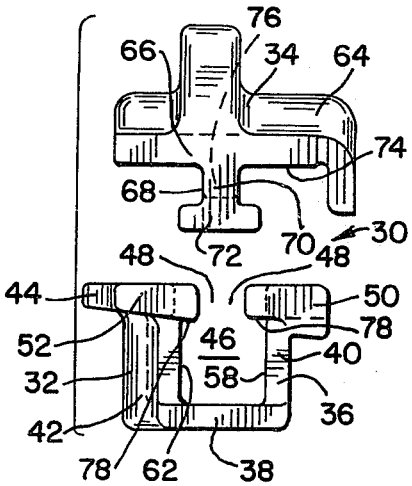
FIG. 3 is a side elevational view of the carrier assembly of FIGS. 1 and 2 wherein a saddle casting portion and a carrier portion, i.e. an adapter in this case, of the carrier assembly are shown disassembled.

As best understood by viewing FIGS. 1 and 2, the coupler shank 14 rests within the cradle area 64 of the saddle casting portion 34. The saddle casting portion 34 in turn is mounted within the adapter 32 such that the vertical part 70 of each lug 68 and the rib 76 are disposed in the adapter slot 48. The horizontal part 72 of each lug 68 resides in the inner space 46 of the adapter base 36 and below the flange 44. When the shank 14 is aligned with the longitudinal axis of the railroad car, the saddle lugs 68 are aligned with the grooves 54 and notches 60 in the adapter 32.

During any lateral movement of the shank 14 and attached coupler head 12, for example as the railroad car travels about a curved section of track, the shank 14 rotates about the pin 24. During this lateral movement, the saddle casting portion 34 slides along the slot 48 to accommodate this change in position of the shank 14.

A change in position also may occur when the railroad car attached to the coupler system 10 is inverted to dump its contents. During the inversion, the coupler head 12, shank 14, pin 24 and yoke collar 22 rotate within the yoke 26. As these components approach a 90 degree point in the inversion cycle, the pin 24 becomes horizontally disposed allowing the shank 14 and coupler head 12, under the influence of gravity, to move. This movement causes a like movement of the saddle portion 34 such that the saddle casting lugs 68 no longer align with the grooves 54 and the notches 60 in the adapter 32. Thus, the saddle casting portion 34 is prevented from disassembly from adapter 32 by the interference of the horizontal part 72 of the lugs 68 with a bottom surface 78 of the adapter flange 44.

After an extensive number of rotations of the shank 14 during the dumping procedure and longitudinal travel, the cradle area 64 of the saddle casting portion 34 becomes worn such that the shank 14 and coupler head 12 begin to droop, i.e. angular deviation from the horizontal axis. When this droop becomes excessive, the saddle casting portion 34 must be replaced.

To replace the saddle casting portion 34, the coupler head 12 and shank 14 are lifted upward so as to provide a clearance space between the shank 14 and cradle area 64 of the saddle casting portion 34. Next the saddle casting portion 34 is moved laterally so that the lugs 68 align with the notches 60 and grooves 54 in the adapter flange 44. The saddle casting portion 34 may then be raised so that the horizontal parts 72 of the lugs 68 are above a bottom of each groove 54. The saddle casting portion 34 may then be slid forward and removed from the adapter 32. A new saddle casting portion then may be substituted by following the above-noted steps in a reverse order.

In FIGS. 9–13 is a further embodiment of this inventive carrier assembly which is shown generally and designated 80. Like reference numbers will be used in FIGS. 9–13 to identify identical structural features common to both embodiments. The carrier assembly 80 is to be inclined in a type-E rotary railroad coupler system also designated 10, being developed for use by the U.S. railroad industry.

The carrier assembly 80 includes the like saddle casting portion 34 mounted within a carrier portion 82. The carrier portion 82 is formed as an integral part of a type-E striker casting 84. The striker casting 84 in turn is carried in a like manner as the striker 16 by a sill 18.

The striker casting 84 has a hollow body portion 86 defined in part by spaced vertical sidewalls 88, 90 which have outwardly flaired ends 91. A forward facing peripheral flange 92 joins the flanged end 91 of the two sidewalls 88, 90. The flange 92 includes a top portion 94, side portions 96, 98 and a bottom portion 100. This flange portion 94–100 defines an opening 102 which provides access to the hollow body portion 86 of the striker casting 84.

The bottom flange portion 100, which forms part of the carrier portion 82, includes a vertical front wall 104 and an upper and lower ledge 106, 108 attached thereto. Each ledge 106, 108 extends to the rear. The upper ledge 106 is horizontal while the lower ledge 108 is V-shaped to converge downwardly and form an apex 110 which aligns with a longitudinal axis of the coupler system 10. Above the lower ledge apex 110 and extending between the upper and lower ledges 106, 108 is a rib 112. The rib 112 integrally joins a rear surface 114 of the bottom flange portion front wall 104, a bottom surface 116 of the upper ledge 106 and a top surface 118 of the lower ledge 108.

The upper ledge 106 is divided longitudinally by a slot 120 into a front section 122 and a rear section 124. The slot 120 is full width having ends terminating adjacent the striker casting sidewalls 88, 90. Additionally, the top ledge 106 has a front full width front step 126 which extends into the front wall 104 and has ends terminating adjacent the side flange portions 96, 98. This front step 126 has a rectangular cross-sectional configuration.

The front section 122 of the upper ledge 106 is further divided by a pair of grooves 128, 130 which are equispaced on each side of the longitudinal axis of the coupler system 10 and extend from the front wall 104 to the slot 120. Aligned with the notches 128, 130 is a pair of recesses 132, 134 formed in the bottom surface 116 of the upper ledge rear section 124. The slot 120 provides access to an inner space 136 defined by the side flange portions 96, 98, the upper and lower ledges 106, 108, and the front wall 104.

Figure 10:
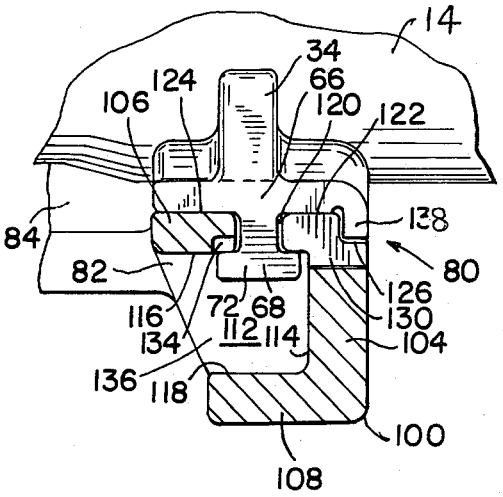
FIG. 10 is a fragmentary cross-sectional view of the carrier assembly of FIG. 9 as seen generally along line 10—10 of FIG. 9.
Figure 11:
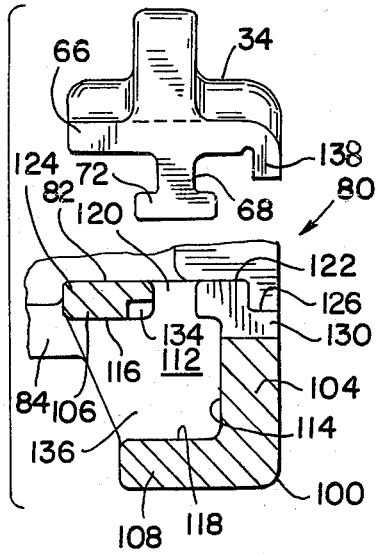
FIG. 11 is a side elevational view of the carrier assembly of FIGS. 9 and 10 wherein the saddle casting portion is shown disassembled from the carrier portion.
Figure 12:
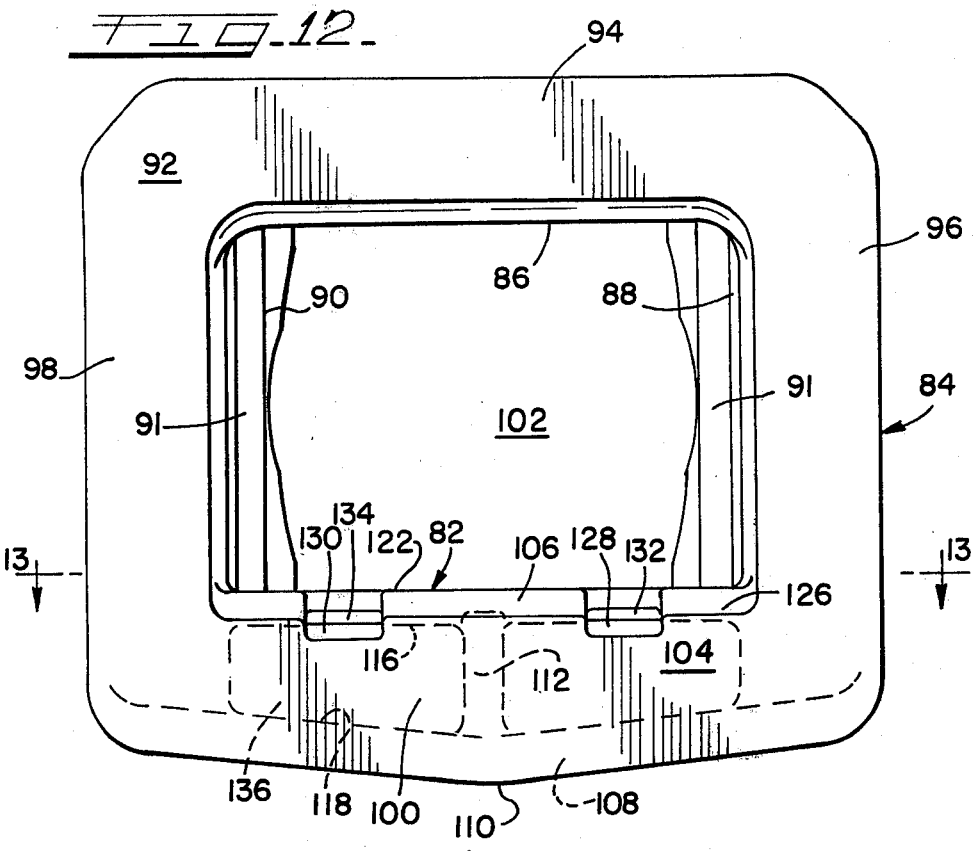
FIG. 12 is a front elevational view of the type-E striker casting of the coupler of FIG. 9 shown without the coupler head and shank, the saddle casting portion of the carrier assembly and the coupler sill.
Figure 13:
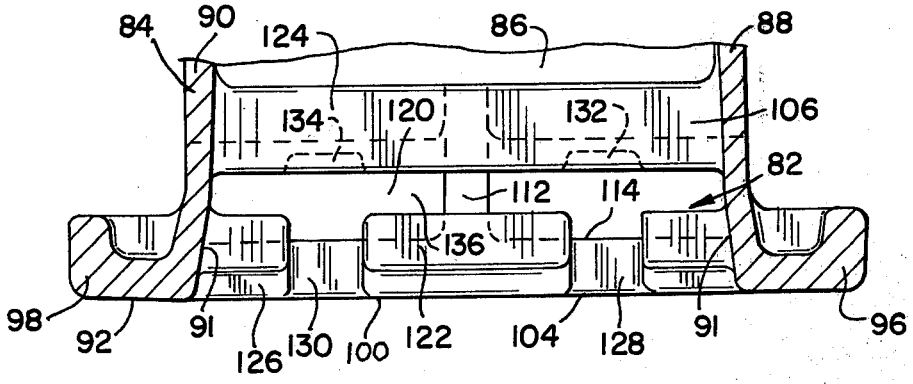
FIG. 13 is a fragmentary cross-sectional view of the striker casting of FIG. 12 as seen generally along the line 13—13 of FIG. 12.

The saddle casting portion 34 may be assembled to or disassembled from the carrier portion 82 in a manner somewhat similar to the procedure used with the first embodiment. First, the coupler head 12 and shank 14 must be raised. Assuming that the saddle casting portion 34 is assembled to the striker casting carrier portion 82 as seen in FIG. 10, the saddle casting portion 34 may then be slid laterally until the lugs 68 are aligned with the recesses 132, 134 in the rear ledge section 124 and the grooves 128, 130 in the front ledge section 122. The saddle casting portion 34 next may be raised until the horizontal part 72 of each lug 68 fits within the recesses 132, 134. Then the saddle casting portion 34 may be brought forward through the grooves 128, 130 to completely disassembly. Note that the flaired ends 91 of the striker casting sidewalls 88, 90 provide additional space for manual manipulation of the saddle casting portion 34. Assembly of the saddle casting portion 34 to the carrier portion 82 may be accomplished by reversing the steps discussed.

Figure 9:
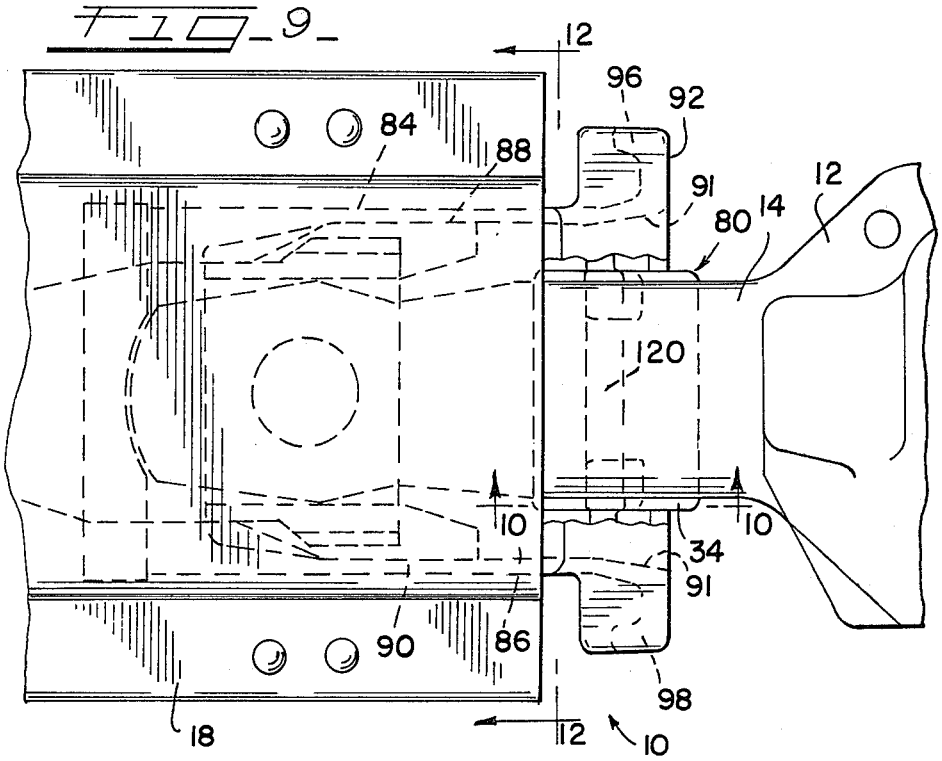
FIG. 9 is a plan view of a portion of a proposed type-E rotary railroad coupler incorporating a further embodiment of this inventive carrier assembly.

In an assembled condition as seen in FIGS. 9 and 10, movement of the saddle casting portion 34 to a position of nonalignment with the longitudinal axis of the coupler system 10 produces an interference between the horizontal parts 72 of the lugs 68 and the bottom surface 116 of the upper ledge 106. Thus, disassembly is prevented except as noted above. During such lateral movement, the saddle casting portion 34 is guided by the saddle casting rib 76 and the upper vertical part 70 of each lug 68 which engages with the ledge slot 120. Additional guidance is provided by engagement between the ledge front step 126 and a downward extending lip 138 formed across a front of the saddle casting portion 34. Engagement of the saddle casting portion lip 138 with the ledge front step 126 reduces the concentration of forces on the saddle casting lugs 68 when the coupler system 10 is subjected to a buffing force. Overall lateral movement of saddle casting portion 34 is limited by engagement between the casting sidewalls 66 with the striker casting sidewalls 88, 90.

While various modifications may be suggested by those versed in the art, it should be understood that I wish to embody within the scope of the patent warranted hereon all such modifications as reasonably and properly come within the scope of my contribution to the art.

What is claimed is:

1. In a rotary type railroad coupler system wherein a type E coupler head and cylindrical shank are rotatively joined to a yoke collar by a retractable pin, said shank being held substantially horizontal by a carrier assembly connected to a striker casting of said coupler system, said carrier assembly comprising a saddle casting portion and a carrier portion with said coupler shank being engaged with an upper cradle area of said saddle casting portion, an improvement in said carrier assembly comprising, lug means formed on a bottom of said saddle casting portion, said lug means providing guidance of said saddle casting portion during sideways movement of said saddle casting portion relative to said carrier portion and locking to selectively maintain said portions in an assembled relationship, and groove means formed laterally to a longitudinal slot in an upper member of said carrier portion, said groove means providing passage of said saddle casting portion lug means upon alignment of said saddle casting portion lug means and said carrier portion groove means, wherein said portions may be assembled or disassembled by aligning said saddle casting lug means with said carrier portion groove means and then moving said lug means through said groove means, with assembly or disassembly of said portions inhibited by misaligning said saddle casting portion lug means and said carrier portion groove means.

2. In a rotary type railroad coupler system wherein a type-E coupler head and cylindrical shank are rotatively joined to a yoke collar by a retractable pin carried by said coupler system, said shank and said coupler head being held substantially horizontal by a carrier assembly connected to a striker casting of said coupler system, the improvement in said carrier assembly comprising, a carrier portion connected with said coupler striker casting, said carrier portion including a lateral slot formed in an upper horizontal member and groove means formed in said member and intersecting with said slot, said groove means and said slot providing access to an inner space within said carrier portion, and a saddle casting portion having an upper cradle area to supportively receive said coupler shank, lug means extending downwardly from said cradle area, said lug means slideable in said groove means and said slot of said carrier portion and being selectively placeable within said carrier portion inner space, said lug means having a lower engaging part to form an interference fit with said carrier portion horizontal member upon said lug means moving laterally to a nonaligning position with respect to said groove means to inhibit upward movement of said saddle casting portion and an upper vertical part to fit within said carrier portion slot and provide guidance to lateral movements of said saddle casting portion, said carrier assembly further comprising, said carrier portion formed integrally as part of said striker casting, said casting including a hollow body portion defined by spaced sidewalls joined to a forward facing peripheral flange, said flange defining an opening to said hollow body portion for disposition of said coupler shank and including a bottom flange portion connecting with side flange portions joined to flaired ends of said sidewalls, said bottom flange portion including an upper ledge forming in part said carrier portion horizontal member, said lateral slot dividing said ledge into a front section and a rear section and having ends terminating adjacent to said striker casting sidewalls, said groove means comprising a pair of spaced grooves formed in said ledge front section to connect said slot with a front step, said front step formed as part of said front ledge section and a front wall of said bottom flange portion and positioned parallel to said slot, and said groove means further comprising a pair of recesses formed in a bottom surface of said rear ledge section to align with said grooves respectively, said grooves and said recesses being equispaced on each side of a longitudinal axis of said coupler system, and said saddle casting portion including a downwardly extending front lip receivable in said front step upon said saddle casting portion lug means being disposed in said carrier portion inner space defined in part by said bottom flange portion front wall and a lower ledge connected thereto, wherein said saddle casting portion may be selectively disassembled from said carrier portion by aligning said saddle casting portion lug means with said carrier portion grooves, with disassembly being inhibited upon said lug means moving in said inner space to a nonaligning position with said grooves.

3. In a railroad car coupler system including an elongated sill having one end attached to a body of a railroad car, a striker attached to an outer end of said sill, a yoke carried within said striker, said yoke receiving an inner end of a shank having a coupler head assembly disposed at an outer end thereof, a rectangular-shaped spring box laterally disposed at an outer end of said striker, said box having an open top proximately aligned with a bottom of said sill, and a saddle assembly, the improvement therein comprising, an adapter having an elongated, hollow base and an upper flange attached to said base, said base disposed in said spring box with a bottom surface of said flange in contact with said top of said box to support said adapter, said flange being divided into a rear section and a front section by an elongated slot proximately aligned with a longitudinal axis of said adapter, a set of spaced, parallel grooves extending laterally across said front flange section, each said groove divided into a shallow front part and a deep rear part, said shallow and deep groove parts joining at a point proximately aligned with an inner surface of a front wall of said base, and spaced parallel, notches formed in said rear flange section to align with said grooves respectively, said notches terminating within said rear flange section at a point proximately aligned with an inner surface of a rear wall of said base at outer ends of said base rear wall, and a saddle casting portion having an upper cradle area to receive said shank of said coupler and spaced lugs extending downwardly from a bottom surface thereof and proximately aligning respectively with outer sides of said saddle casting portion, each said lug having an inverted T-shaped cross sectional configuration comprising an upper vertical part and a lower horizontal part, said lower horizontal parts passable through said grooves and notches in said adapter front and rear flange section with end walls of said lug lower horizontal portions lying substantially proximate to and guidable by said inner surfaces of said adapter front and rear wall at said outer ends of such, and a rib extending between said lugs, said rib disposable in said adapter flange slot with said rib and said lug upper vertical parts slidable within said slot, wherein said saddle casting portion may be assembled or disassembled from said adapter by alignment of said saddle casting portion lugs with said adapter grooves and notches and movement of said lugs therethrough with assembly or disassembly being inhibited upon said lugs being misaligned with said grooves and notches.

* * * * *